US010598386B2

(12) United States Patent
Paller

(10) Patent No.: US 10,598,386 B2
(45) Date of Patent: Mar. 24, 2020

(54) FUEL SUPPLY SYSTEM FOR A GAS BURNER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 15/787,777

(22) Filed: Oct. 19, 2017

(65) Prior Publication Data

US 2019/0120495 A1 Apr. 25, 2019

(51) Int. Cl.

| | |
|---|---|
| ***F24C 3/12*** | (2006.01) |
| ***F23D 14/06*** | (2006.01) |
| ***F23K 5/00*** | (2006.01) |
| ***F23D 14/08*** | (2006.01) |

(52) U.S. Cl.

CPC ..... *F24C 3/122* (2013.01); *F23D 14/06* (2013.01); *F23D 14/08* (2013.01); *F23K 5/005* (2013.01); *F23K 5/007* (2013.01); *F23D 2900/14062* (2013.01); *F23K 2900/05002* (2013.01)

(58) Field of Classification Search

CPC ..... F23D 14/08; F23K 2900/05002; F23K 5/005; F23K 5/007; F24C 3/122

See application file for complete search history.

(56) References Cited

U.S. PATENT DOCUMENTS

| | | | | |
|---|---|---|---|---|
| 1,923,393 A * | 8/1933 | Pickup | F23D 14/64 239/543 |
| 3,525,325 A | 8/1970 | Perl | |
| 4,349,330 A * | 9/1982 | Obinata | F23D 11/001 431/60 |
| 4,424,793 A | 1/1984 | Cooperrider | |
| 6,322,354 B1 | 11/2001 | Carbone et al. | |

(Continued)

FOREIGN PATENT DOCUMENTS

| | | |
|---|---|---|
| CN | 1076516 A | 9/1993 |
| EP | 0887590 A1 | 12/1998 |

(Continued)

OTHER PUBLICATIONS eductors.net; "How Does an Eductor Work"; Jul. 24, 2015; http://eductors.net/eductor-work/ (Year: 2015).*

*Primary Examiner* — Jorge A Pereiro
*Assistant Examiner* — Logan P Jones
(74) *Attorney, Agent, or Firm* — Dority & Manning, P.A.

(57) ABSTRACT

A fuel supply system for a gas burner assembly includes an eductor for providing a mixed flow of fuel into a fuel chamber of the gas burner assembly. The eductor includes a suction chamber defining a suction inlet, a motive nozzle positioned within the suction chamber, and an eductor outlet positioned proximate an inlet to the fuel chamber. A fuel supply provides a first flow of fuel through a first fuel supply conduit to the suction inlet and a second flow of fuel through a second fuel supply conduit to the motive nozzle. A fuel pump is operably coupled to the second fuel supply conduit for increasing a pressure of the second flow of fuel such that the second flow generates a negative pressure within the suction chamber to increase the first flow of fuel.

16 Claims, 5 Drawing Sheets

(56) References Cited

U.S. PATENT DOCUMENTS

| | | | | |
|---|---|---|---|---|
| 8,479,721 | B2 | 7/2013 | Graham et al. | |
| 8,845,326 | B2 | 9/2014 | Shaffer et al. | |
| 8,960,234 | B2 | 2/2015 | Cadeau et al. | |
| 2005/0221243 | A1* | 10/2005 | Najewicz | F23D 14/04 431/18 |
| 2005/0284155 | A1* | 12/2005 | Bhatt | F04F 1/06 62/50.2 |
| 2009/0145422 | A1* | 6/2009 | Paesani | F23D 14/06 126/39 E |

FOREIGN PATENT DOCUMENTS

| | | | |
|---|---|---|---|
| JP | 2000314510 | A | 11/2000 |
| KR | 100838429 | B1 | 6/2008 |

* cited by examiner

FUEL SUPPLY SYSTEM FOR A GAS BURNER ASSEMBLY

FIELD OF THE INVENTION

The present subject matter relates generally to gas burner assemblies, and more particularly, to fuel supply assemblies for supplying fuel into gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Normally aspirated gas burners rely on the energy available in the form of pressure from the fuel supplied to the gas burner to entrain air for combustion. Because the nominal fuel pressure in households is relatively low, there is a practical limit to the amount of primary air a normally aspirated gas burner can entrain. Introducing a fuel pump into a gas burner assembly may increase the fuel pressure. However, fuel pumps used to achieve the desired fuel pressure increase are often large, expensive, and noisy. In addition, relying on large fuel pumps to increase the pressure of a flow of fuel can result in safety concerns that must be addressed. For example, if the fuel pump fails, the potential for carbon monoxide exposure can result in the need for costly and complicated failure detection sensors or devices, such as pressure switches or pressure-controlled valves.

Accordingly, a cooktop appliance including an improved gas burner assembly with improved aeration would be desirable. More particularly, a fuel supply system for a gas burner assembly that increases the pressure of a flow of fuel to entrain more air without requiring costly and noisy fuel pumps would be particularly beneficial.

BRIEF DESCRIPTION OF THE INVENTION

The present disclosure relates generally to a fuel supply system for a gas burner assembly which includes an eductor for providing a mixed flow of fuel into a fuel chamber of the gas burner assembly. The eductor includes a suction chamber defining a suction inlet, a motive nozzle positioned within the suction chamber, and an eductor outlet positioned proximate an inlet to the fuel chamber. A fuel supply provides a first flow of fuel through a first fuel supply conduit to the suction inlet and a second flow of fuel through a second fuel supply conduit to the motive nozzle. A fuel pump is operably coupled to the second fuel supply conduit for increasing a pressure of the second flow of fuel such that the second flow generates a negative pressure within the suction chamber to increase the first flow of fuel. Additional aspects and advantages of the invention will be set forth in part in the following description, or may be apparent from the description, or may be learned through practice of the invention.

In one exemplary embodiment, a cooktop appliance is provided including a top panel and a gas burner assembly positioned at the top panel. The gas burner assembly includes a burner body defining a fuel chamber and a plurality of flame ports, the fuel chamber being in fluid communication with the plurality of flame ports. A fuel supply system is positioned proximate an inlet of the fuel chamber for providing a flow of fuel into the fuel chamber. The fuel supply system includes an eductor including a suction chamber defining a suction inlet, a motive nozzle positioned within the suction chamber, and an eductor outlet. A first fuel supply conduit is fluidly coupled to the suction inlet for providing a first flow of fuel into the suction chamber. A second fuel supply conduit is fluidly coupled to the motive nozzle for providing a second flow of fuel into the suction chamber, the second flow of fuel having a higher pressure than the first flow of fuel.

In another exemplary embodiment, a fuel supply system for a gas burner assembly is provided. The gas burner assembly includes a burner body defining a fuel chamber having an inlet. The fuel supply system includes an eductor including a suction chamber defining a suction inlet, a motive nozzle positioned within the suction chamber, and an eductor outlet. A fuel supply provides a primary flow of fuel to a primary conduit. A first fuel supply conduit provides fluid communication between the primary conduit and the suction inlet for providing a first flow of fuel into the suction chamber. A second fuel supply conduit provides fluid communication between the primary conduit and the motive nozzle for providing a second flow of fuel into the suction chamber. A fuel pump is operably coupled to the second fuel supply conduit for increasing a pressure of the second flow of fuel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
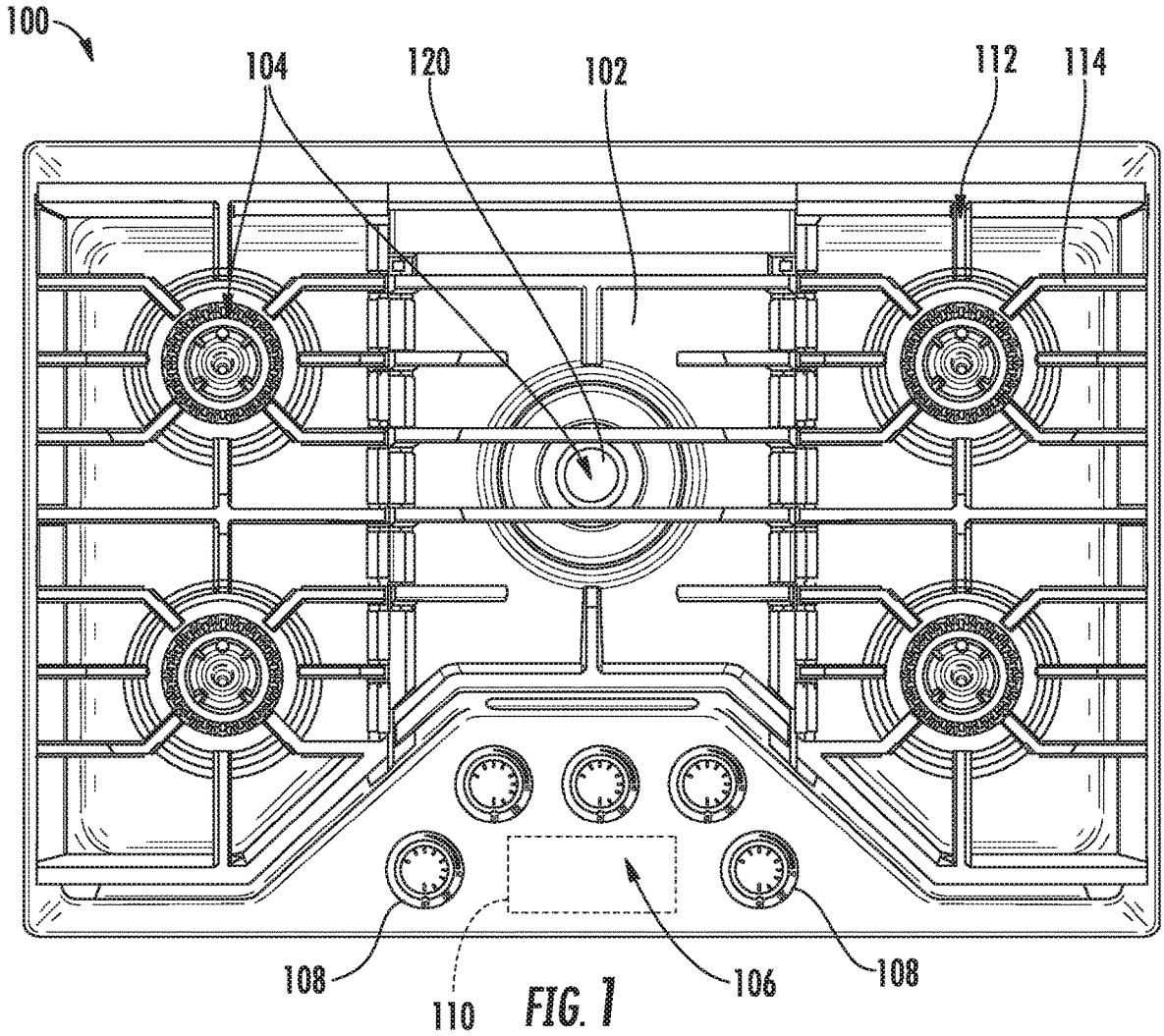
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

Operation of cooktop appliance 100 is controlled by electromechanical switches or by a controller or processing device 110 (FIG. 1) that is operatively coupled to control panel 106 for user manipulation, e.g., to control the operation of heating elements 104. In response to user manipulation of control panel 106, controller 110 operates the various components of cooktop appliance 100 to execute selected instructions, commands, or other features.

Controller 110 may include a memory and microprocessor, such as a general or special purpose microprocessor operable to execute programming instructions or micro-control code associated with appliance operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 106 and other components of cooktop appliance 100 may be in communication with controller 110 via one or more signal lines or shared communication busses.

According to the illustrated embodiment, cooktop appliance 100 is a gas cooktop and heating elements 104 are gas burners, such as a gas burner assembly 120 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 112 configured to support a cooking utensil, such as a pot, pan, etc. In general, grates 112 include a plurality of elongated members 114, e.g., formed of cast metal, such as cast iron. The cooking utensil may be placed on the elongated members 114 of each grate 112 such that the cooking utensil rests on an upper surface of elongated members 114 during the cooking process. Heating elements 104 are positioned underneath the various grates 112 such that heating elements 104 provide thermal energy to cooking utensils above top panel 102 by combustion of fuel below the cooking utensils.

Figure 2:
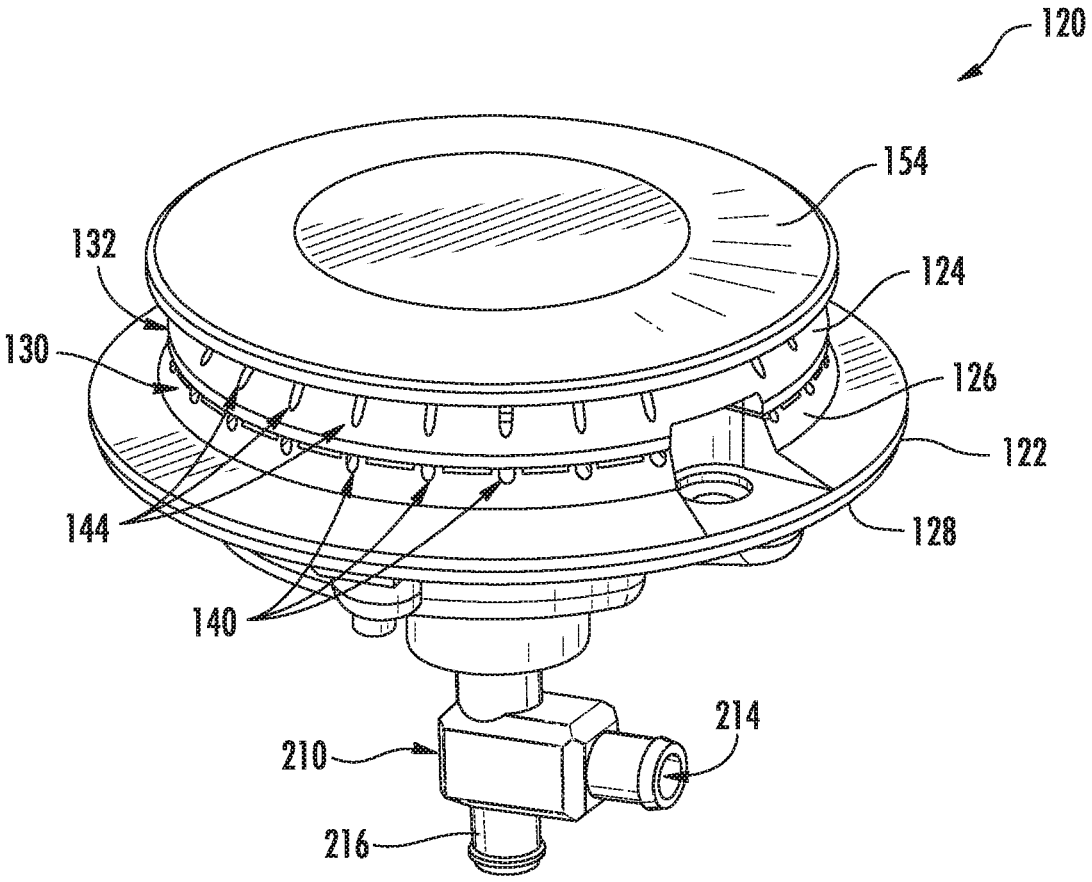
FIG. 2 provides a perspective view of a gas burner assembly of the exemplary cooktop appliance of FIG. 1 according to an exemplary embodiment of the present subject matter.
Figure 3:
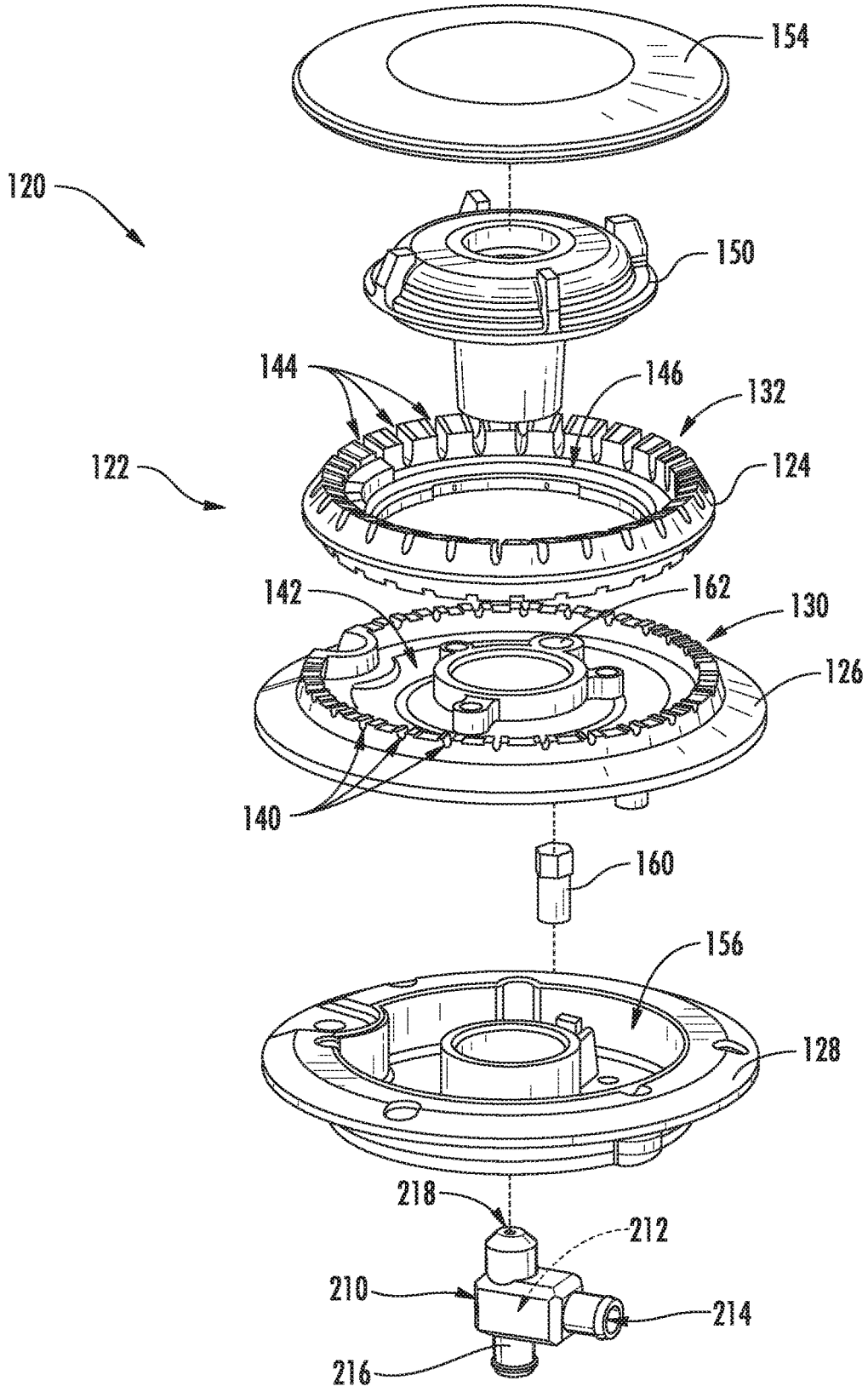
FIG. 3 provides an exploded perspective view of the exemplary gas burner assembly of FIG. 2.
Figure 4:
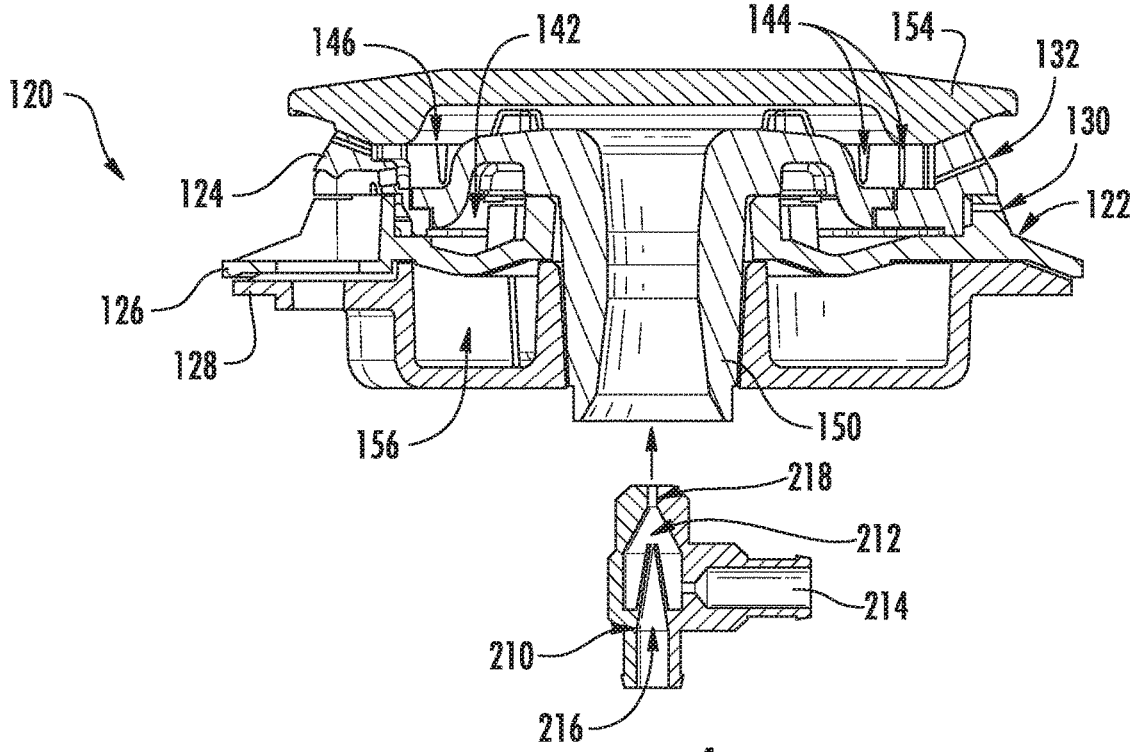
FIG. 4 provides a cross sectional view of the exemplary gas burner assembly of FIG. 2.
Figure 5:
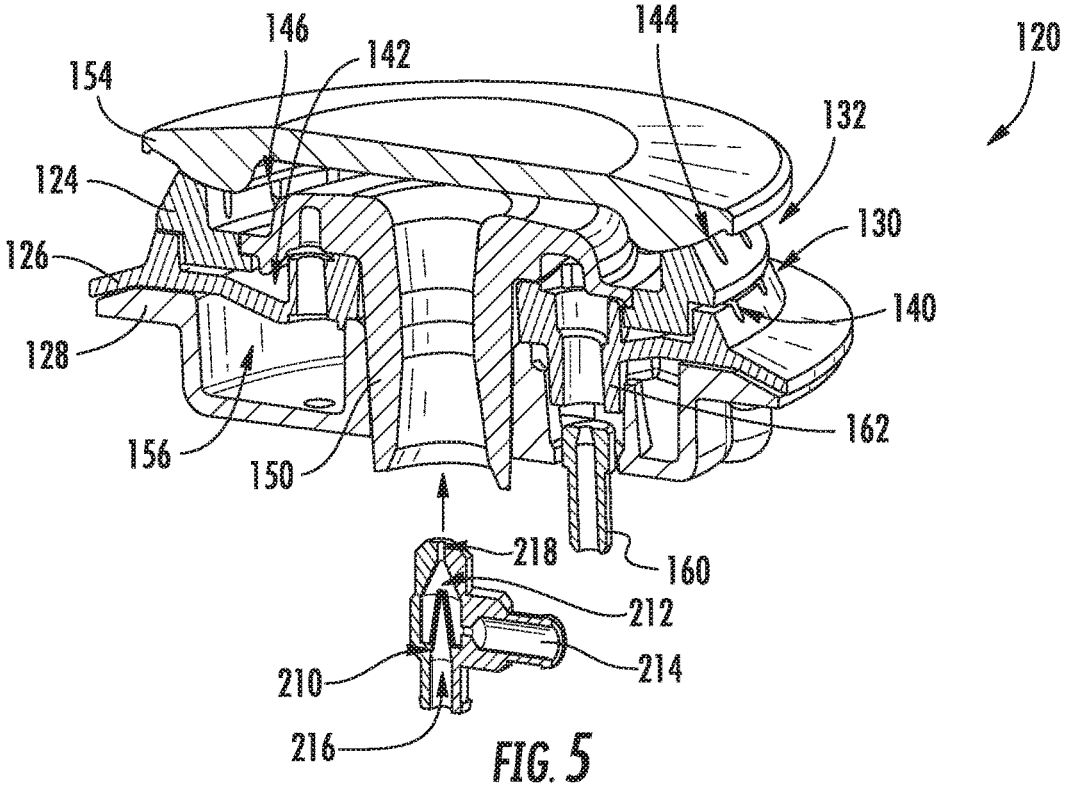
FIG. 5 provides another cross sectional view of the exemplary gas burner assembly of FIG. 2.

FIG. 2 is a perspective view of gas burner assembly 120. FIG. 3 is an exploded view of gas burner assembly 120. FIGS. 4 and 5 are section views of gas burner assembly 120. As an example, gas burner assembly 120 may be used in cooktop appliance 100 (FIG. 1) as one of heating elements 104. However, it will be understood that, while described in greater detail below in the context of cooktop appliance 100, gas burner assembly 120 may be used in or with any suitable appliance in alternative example embodiments.

As may be seen in FIGS. 2 through 5, gas burner assembly 120 includes one or more burner bodies 122, which may include for example, a first burner body 124, a second burner body 126, and a third burner body 128. Burner bodies 122 generally define a first burner ring or stage 130 (e.g., a primary burner) and a second burner ring or stage 132 (e.g., a boost burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 120 may also include an air duct 150 and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 120. Thus, first fuel chamber 142 is not in flow communication with second fuel chamber 146 within gas burner assembly 120. In addition, an air chamber 156 may be defined by second burner body 126 and third burner body 128.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when both stages 130, 132 are ignited. For example, flames at first burner stage 130 may assist with lighting gaseous fuel at second burner stage 132 due to the position of first burner stage 130 below second burner stage 132.

According to the exemplary illustrated embodiment, first burner stage 130 is a normally aspirated burner that relies on the energy available in the form of pressure from the fuel supplied to the gas burner to entrain air for combustion. In this regard, for example, as best shown in FIGS. 3 and 5 a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

Figure 6:
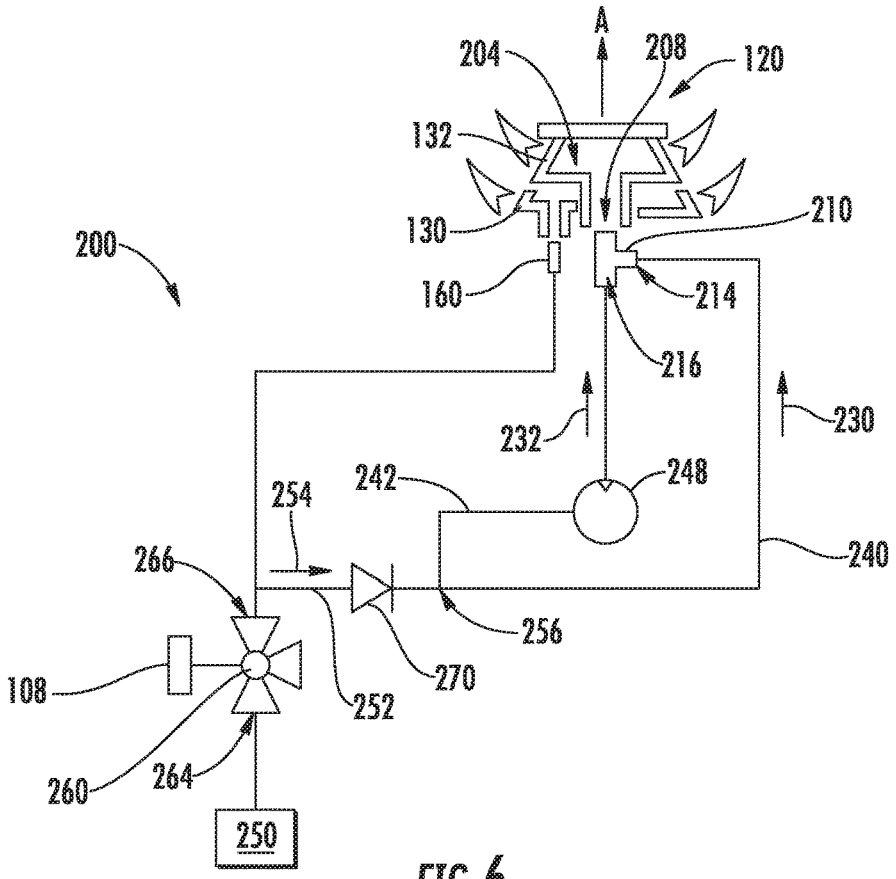
FIG. 6 provides a schematic view of a fuel supply system for providing a flow of fuel to a gas burner assembly according to an example embodiment of the present subject matter.
Figure 7:
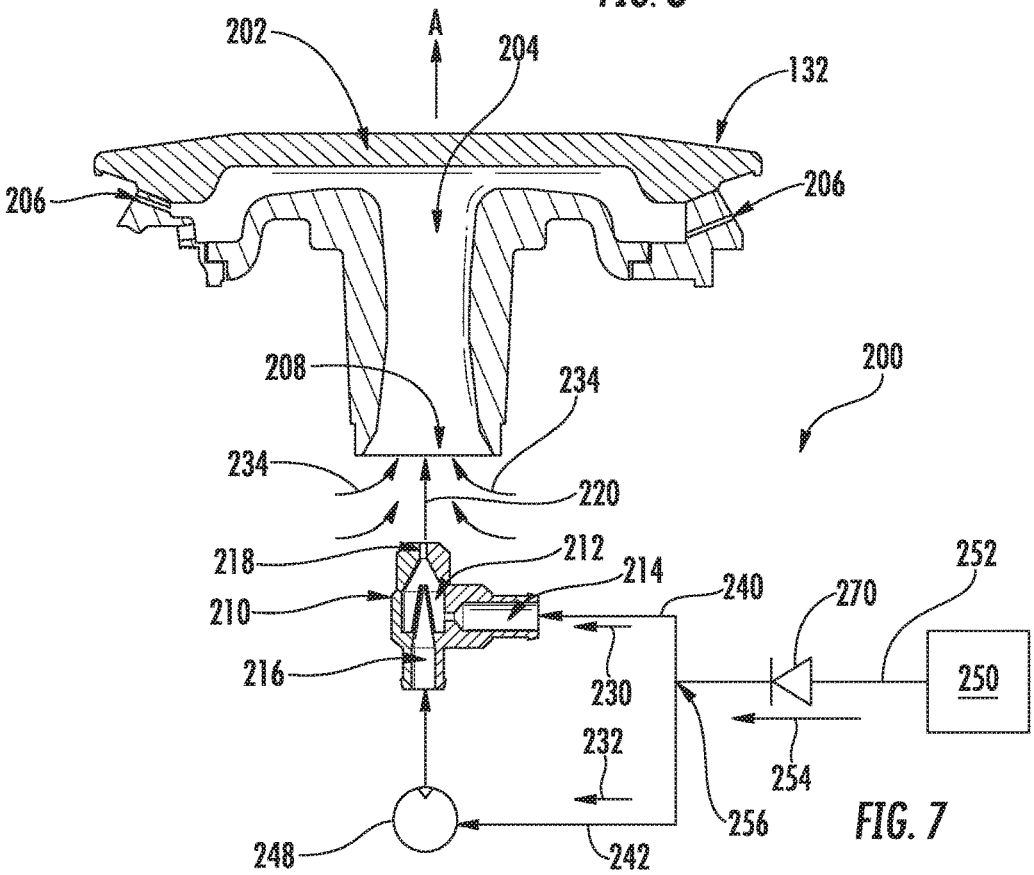
FIG. 7 provides another schematic view of the exemplary fuel supply system and gas burner assembly of FIG. 6 according to an example embodiment of the present subject matter.

Referring now to FIGS. 6 and 7, schematic views of gas burner assembly 120 and a fuel supply system 200 will be described according to an exemplary embodiment. For the purpose of explanation, simplified renderings of gas burner assembly 120 are illustrated in FIGS. 6 and 7. For example, only first burner stage 130 and second burner stage 132 are illustrated in schematic form in FIG. 6. In addition, FIG. 7 illustrates only second burner stage 132 for purposes of illustration and simplified explanation. Similar reference numerals may be used to refer to the same or analogous features throughout the figures. In addition, although fuel supply system 200 is illustrated as being used with gas burner assembly 120, it should be appreciated that fuel supply system 200 as described herein may be used in any suitable gas burner assembly and in any suitable cooktop appliance.

In general, fuel supply system 200 is configured for selectively supplying gaseous fuel such as propane or natural gas to first burner stage 130 and second burner stage 132 to regulate the amount of heat generated by the respective stages. In particular, fuel supply system 200 regulates the output of both first and second burner stages 130, 132 depending upon the desired output of gas burner assembly 120 selected by a user of gas burner assembly 120, e.g., using control knob 108. Thus, first burner stage 130 is separate or independent from second burner stage 132, e.g., such that first burner stage 130 is not in fluid communication with second burner stage 132 within gas burner assembly 120. In such manner, gaseous fuel within gas burner assembly 120 does not flow between first and second burner stages 130, 132.

As illustrated, gas burner assembly 120 may include a burner body 202 (such as burner bodies 122) which generally defines a fuel chamber 204 (such as, for example, fuel chambers 142 or 146) and a plurality of flame ports 206 (such as, for example, plurality of flame ports 140 or 144). In addition, burner body 202 also defines an inlet 208 through which the mixture of fuel and air may flow into fuel chamber 204 for combustion at flame ports 206.

According to the illustrated embodiment, fuel supply system 200 also includes an eductor 210 that is positioned proximate inlet 208 of burner body 202. As used herein, an "eductor" may refer generally to Venturi-jet or other devices that use a pressurized first flow of fluid to entrain, mix, and/or pump a second flow of fluid. More specifically, as illustrated in FIG. 7, eductor 210 includes a suction chamber 212 that defines a suction inlet 214. In addition, a motive nozzle 216 is positioned within suction chamber 212. Eductor 210 also defines an eductor outlet 218 through which a mixed flow of fuel 220 is ejected toward inlet 208 of burner body 202.

According to an exemplary embodiment, during operation of fuel supply system 200, a first flow of fuel 230 (e.g., a relatively low-pressure flow of fuel) is provided into suction chamber 212 through suction inlet 214. Simultaneously, a second flow of fuel 232 (e.g., a relatively high pressure flow of fuel) is provided to motive nozzle 216 where it is ejected into suction chamber 212 and through eductor outlet 218. In addition, motive nozzle 216 may have a Venturi-shaped profile or constriction which causes the second flow of fuel 232 to accelerate out of motive nozzle 216 and out of eductor outlet 218, thereby generating a relative pressure difference by the Venturi effect. In this manner, the second flow of fuel 232 passing through motive nozzle 216 reduces the pressure or otherwise creates a vacuum condition within suction chamber 212 which draws in additional fuel from suction inlet 214, i.e., increases the flow rate of the first flow of fuel 230.

According to the illustrated embodiment, eductor outlet 218 is positioned and oriented for directing the second flow of fuel 232 through suction chamber 212 and directly out eductor outlet 218. Referring now specifically the FIG. 7, eductor 210 is generally positioned proximate inlet 208 of fuel chamber 204. More specifically, for example, eductor outlet 218 may be positioned just below inlet 208 of fuel chamber 204 along an axial direction A. In addition, eductor 210, motive nozzle 216, and eductor outlet 218 may be oriented axially for directing mixed flow of fuel 220 directly into inlet 208. Although one exemplary embodiment of eductor 210 is described herein, it should be appreciated that eductor 210 may have any other suitable size, shape, position, size and number of chambers, number of inlets/outlets, and orientation relative to inlet 208 while remaining within scope of the present subject matter.

In addition, a source entrainment air 234 may be provided between eductor outlet 218 and inlet 208 of fuel chamber 204 such that the flow of mixed fuel 220 may entrain air (as indicated by reference numeral 234 in FIG. 7) before entering inlet 208. For example according to the illustrated embodiment, the space between eductor 210 and inlet 208 is open to ambient air or otherwise in fluid communication with and air chamber or supply such that mixed flow of fuel 220 may entrain air 234 as it enters inlet 208.

Referring still to FIGS. 6 and 7, fuel supply system 200 further includes a first fuel supply conduit 240 that is fluidly coupled to suction inlet 214 for providing the first flow of fuel 230 into suction chamber 212. Similarly, a second fuel supply conduit 242 is fluidly coupled to motive nozzle 216 for providing the second flow of fuel 232 into suction chamber 212, as described above. Notably, according to the exemplary embodiment, the second flow of fuel 232 has a higher pressure than the first flow of fuel 230, as described herein.

According to exemplary embodiments of the present subject matter, the two flows of fuel 230, 232 may be provided from any suitable supply source or sources. However, according to the illustrated embodiment, the relative pressure difference between the two flows of fuel 230, 232 is achieved using a fuel pump 248, as described below. More specifically, for example, fuel supply system 200 may include a single fuel supply 250, such as a natural gas supply line or a propane tank. Gaseous fuel (e.g., natural gas or propane) is flowable from the pressurized fuel supply 250 into a primary conduit 252 which is fluidly coupled to fuel supply 250 for providing a primary flow of fuel 254. As illustrated, primary conduit 252 is split at a junction 256 into first fuel supply conduit 240 and second fuel supply conduit 242, e.g., via a plumbing tee, wye, or any other suitable splitting device.

Referring again to FIG. 6, fuel supply system 200 further includes a control valve 260 operably coupled to primary conduit 252 for selectively directing a metered amount of fuel to gas burner assembly 120. More specifically, control valve 260 includes a valve inlet 264 fluidly coupled with fuel supply 250 and a valve outlet 266 fluidly coupled with primary conduit 252 for supplying gaseous fuel to eductor 210. According to the exemplary embodiment, control valve 260 is operably coupled with control knob 108. In this manner, a user of gas burner assembly 120 may control the primary flow of fuel 254 passing through primary conduit 252.

Notably, in order to increase the pressure of second flow of fuel 232, fuel pump 248 is operably coupled to second fuel supply conduit 242. Fuel pump 248 may generally be any device suitable for increasing the pressure of second flow of fuel 232. For example, fuel pump 248 may be a vane, blower, or fan type pump coupled to second fuel supply conduit 242. Fuel pump 248 may be configured for operating when second flow of fuel 232 is detected or may be directly coupled to control knob 108 and may operate accordingly. Other types, positions, and configurations of fuel pump 248 are possible and within the scope of the present subject matter. Notably, by using eductor 210 in conjunction with fuel pump 248, fuel supply system 200 can provide the mixed flow of fuel 220 into gas burner assembly 120 at a higher pressure and with a fuel pump that is smaller, cheaper, and less noisy than if using only a single fuel pump.

Notably, the inclusion of fuel pump 248 within fuel supply system 200 may cause safety concerns related potential carbon monoxide exposure in the event of a failure of fuel pump 248. In this regard, for example, if fuel pump 248 fails to increase the pressure of second flow of fuel 232, the pressure of mixed flow of fuel 220 ejected through eductor outlet 218 may be too low to entrain a sufficient amount of air. As a result, a rich mixture of fuel may be present in fuel chamber 204 which generates a significant amount of carbon monoxide when combusted.

Therefore, according to an exemplary embodiment, fuel supply system 200 may further include a shutoff valve 270 that is operably coupled to primary conduit 252. Shutoff valve 270 is generally configured for closing (thus stopping the primary flow of fuel 254) when a flow rate of the primary flow of fuel 254 drops below a predetermined flow rate. For example, according to one embodiment, shutoff valve 270 is a one-way valve that has a cracking pressure substantially equivalent to the predetermined flow rate. In this manner, when the flow rate of the primary flow of fuel 254 drops below the predetermined flow rate the flap of the one-way valve closes, thus preventing any flow of fuel through primary conduit 252.

Although described as a one-way valve, it should be appreciated that shutoff valve 270 may be any other suitable type of valve for shutting down at any other suitable pressure. For example, shutoff valve 270 may be any pressure regulated valve that closes primary conduit 252 when the flow rate within primary conduit 252 drops to a flow rate, which may be selected or associated with a specific condition or event. For example, the predetermined flow rate at which shutoff valve 270 closes may be the flow rate corresponding to the flow rate when fuel pump 248 fails. According to alternative embodiments, the predetermined flow rate may be selected to correspond to any other suitable operating condition of fuel supply system 200.

Notably, fuel supply system 200 described above may provide several advantages relative to conventional fuel supply assemblies for a gas burner assembly, such as gas burner assembly 120. For example, to achieve a suitable fuel pressure at the inlet of the gas burner assembly, conventional burners require particular fuel pumps, such as a positive displacement pump, which may be large, costly, and noisy. By contrast, using fuel supply 250, fuel pump 248, and eductor 210, the supply of mixed fuel may be provided the inlet of the gas burner using a smaller fuel pump that is significantly lower in cost and noise. In addition, utilization of shutoff valve 270 provides a low-cost, reliable, and effective method for stopping the flow of fuel to the gas burner assembly in the event of a fuel pump failure. Other benefits and advantages of the present subject matter will be apparent to those skilled in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly positioned at the top panel, the gas burner assembly comprising a burner body defining a fuel chamber and a plurality of flame ports, the fuel chamber being in fluid communication with the plurality of flame ports; and a fuel supply system positioned proximate an inlet of the fuel chamber for providing a flow of fuel into the fuel chamber, the fuel supply system comprising:

an eductor comprising a suction chamber defining a suction inlet, a motive nozzle positioned within the suction chamber, and an eductor outlet;

a first fuel supply conduit providing fluid communication between the primary conduit and the suction inlet for providing a first flow of fuel into the suction chamber;

a second fuel supply conduit providing fluid communication between the primary conduit and the motive nozzle for providing a second flow of fuel into the suction chamber, the second flow of fuel having a higher pressure than the first flow of fuel;

a fuel pump fluidly coupled to the second fuel supply conduit for increasing a pressure of the second flow of fuel; and a shutoff valve operably coupled to the primary conduit, the shutoff valve being configured for closing when a flow rate of the primary flow of fuel drops below a predetermined flow rate.

2. The cooktop appliance of claim 1, comprising:

a control valve comprising a valve inlet in fluid communication with the fuel supply and a valve outlet in fluid communication with the primary conduit, the control valve being configured for regulating the primary flow of fuel to the primary conduit.

3. The cooktop appliance of claim 1, wherein the shutoff valve is a one-way valve that has a cracking pressure substantially equivalent to the predetermined flow rate.

4. The cooktop appliance of claim 1, wherein the predetermined flow rate is equivalent to the flow rate of the primary flow of fuel when the fuel pump fails.

5. The cooktop appliance of claim 1, wherein the eductor outlet is positioned just below the inlet of the fuel chamber along an axial direction.

6. The cooktop appliance of claim 1, wherein a source of entrainment air is positioned between the eductor outlet and the inlet of the fuel chamber such that the flow of fuel entrains air before entering the inlet of the fuel chamber.

7. The cooktop appliance of claim 1, wherein the motive nozzle defines a nozzle outlet that is positioned and oriented for directing the second flow of fuel through the suction chamber and directly toward the eductor outlet.

8. The cooktop appliance of claim 1, wherein the fuel chamber is a first fuel chamber and the plurality of flame ports is a first plurality of flame ports, the burner body of the gas burner assembly further defining:

a second fuel chamber in fluid communication with the fuel supply; and a second plurality of flame ports, the second fuel chamber being in fluid communication with the second plurality of flame ports.

9. The cooktop appliance of claim 8, wherein the first plurality of flame ports is positioned concentric with and below the second plurality of flame ports.

10. A fuel supply system for a gas burner assembly, the gas burner assembly comprising a burner body defining a fuel chamber having an inlet, the fuel supply system comprising:

an eductor comprising a suction chamber defining a suction inlet, a motive nozzle positioned within the suction chamber, and an eductor outlet;

a fuel supply for providing a primary flow of fuel to a primary conduit;

a first fuel supply conduit providing fluid communication between the primary conduit and the suction inlet for providing a first flow of fuel into the suction chamber;

a second fuel supply conduit providing fluid communication between the primary conduit and the motive nozzle for providing a second flow of fuel into the suction chamber;

a fuel pump operably coupled to the second fuel supply conduit for increasing a pressure of the second flow of fuel; and a shutoff valve operably coupled to the primary conduit, the shutoff valve being configured for closing when a flow rate of the primary flow of fuel drops below a predetermined flow rate.

11. The fuel supply system of claim 10, comprising:

a control valve operably coupled to the primary conduit for regulating the primary flow of fuel through the primary conduit.

12. The fuel supply system of claim 10, wherein the shutoff valve is a one-way valve that has a cracking pressure substantially equivalent to the predetermined flow rate.

13. The fuel supply system of claim 10, wherein the predetermined flow rate is equivalent to the flow rate of the primary flow of fuel when the fuel pump fails.

14. The fuel supply system of claim 10, wherein the eductor outlet is positioned just below the inlet of the fuel chamber along an axial direction.

15. The fuel supply system of claim 10, wherein a source of entrainment air is positioned between the eductor outlet and the inlet of the fuel chamber such that the flow of fuel entrains air before entering the inlet of the fuel chamber.

16. The fuel supply system of claim 10, wherein the motive nozzle defines a nozzle outlet that is positioned and oriented for directing the second flow of fuel through the suction chamber and directly toward the eductor outlet.

* * * * *